US006336613B1

(12) United States Patent
Roth

(10) Patent No.: US 6,336,613 B1
(45) Date of Patent: Jan. 8, 2002

(54) ADJUSTABLE LIGHTING REFLECTOR BRACKET

(75) Inventor: Peter L. Roth, Dallas, TX (US)

(73) Assignee: C.E.W. Lighting, Inc., Dallas, TX (US)

( * ) Notice: Subject to any disclaimer, the term of this patent is extended or adjusted under 35 U.S.C. 154(b) by 0 days.

(21) Appl. No.: 09/488,866

(22) Filed: Jan. 21, 2000

(51) Int. Cl.[7] ..... G12B 9/00
(52) U.S. Cl. ..... 248/27.1; 248/343
(58) Field of Search ..... 248/342, 343, 248/344, 906, 327, 27.1, 221.11, 916, 224.8; 411/348, 383, 384, 392, 393

(56) References Cited

U.S. PATENT DOCUMENTS

| | | | | | |
|---|---|---|---|---|---|
| 1,690,941 | A | * | 11/1928 | Nickerson | 248/343 |
| 1,849,966 | A | * | 3/1932 | Ureles | 248/343 |
| 2,898,797 | A | * | 8/1959 | Bronstein | 85/5 |
| 3,480,246 | A | * | 11/1969 | Schwartz et al. | 248/327 |
| 3,518,420 | A | * | 6/1970 | Kripp | 240/78 |
| 3,590,238 | A | | 6/1971 | Arens | |
| 3,660,651 | A | | 5/1972 | Miles, Jr. | |
| 4,300,187 | A | | 11/1981 | Fletcher | |
| 4,675,794 | A | | 6/1987 | Fink | |
| 5,017,327 | A | | 5/1991 | Bamber | |
| 5,086,379 | A | | 2/1992 | Denison et al. | |
| 5,523,932 | A | | 6/1996 | Bogdanovs | |
| 5,727,850 | A | * | 3/1998 | Masclet | 301/111 |
| 5,785,416 | A | | 7/1998 | Hansen | |

* cited by examiner

*Primary Examiner*—Ramon O. Ramirez
*Assistant Examiner*—A. Joseph Wujciak
(74) *Attorney, Agent, or Firm*—Thomas W. Cook

(57) ABSTRACT

An adjustable bracket for mounting a lighting reflector is disclosed, useful for conveniently mounting a lighting reflector to a lighting fixture housing by sliding engagement, for easily adjusting the reflector in relation to the housing, thereby focusing or directing light, and for setting the optimal position of the reflector using a spring-biased pin, operable with only a single hand, thereby allowing the user to mount and adjust the reflector using one hand, while freeing the user's second hand for holding the reflector during mounting and adjustment.

11 Claims, 4 Drawing Sheets

ADJUSTABLE LIGHTING REFLECTOR BRACKET

TECHNICAL FIELD OF THE INVENTION

The present invention relates to an adjustable bracket or holder for mounting a lighting reflector. More particularly, the present invention relates to a new assembly by which a user may conveniently mount a lighting to a lighting fixture housing and easily adjust the reflector in relation to the housing, to focus or direct light produced by the lamp residing in the fixture. The mounting and adjusting assembly utilizes a sliding engagement between the reflector and the fixture housing, and at least one spring-biased pin, operable with only a single hand, thereby allowing the user to mount and adjust the bracket using one hand, while freeing the user's second hand for holding the reflector during mounting and adjustment.

BACKGROUND ART OF THE INVENTION

In many lighting fixture installations, and particularly when large lighting fixtures are used, a reflector may be supplied separate from the lighting housing. The reflector in such cases is often secured to the housing after the housing is secured to a beam or other support. Securing the reflector to the housing after the housing is in place allows the user to fasten the housing to the support, and connect electrical wiring, without the necessity of working around the sometimes large reflector. At the same time the user may lift the housing and reflector into position separately, so that no individual piece of the fixture is unmanageably heavy or ungainly.

In many lighting fixture installations a reflector is sufficient to direct light from the lamp to the areas to be lighted, and away from areas where lighting is not desired. Once the reflector is secured to the housing, it is desirable to be able to adjust the reflector in relation to the lamp, in order to refine the light-directing effect of the reflector. In some cases, depending upon the location and application, a refracting globe or lens, or a simple shade, is used to achieve similar light-directing effect.

A number of schemes have been devised to accomplish the adjustment necessary to direct light from the fixture to areas requiring light. These schemes include apparatus for moving the socket holding the lamp within the assembled fixture, pivoting shades, and shades which rotate or slide within other shades. Various designs and configurations for such apparatus, including adjustable mounts, brackets, and other assemblies for connecting shades and reflectors to lighting housings, include:

U.S. Pat. No. 3,660,651 to Miles, which discloses an adjustable light shade for directing light at various angles toward an object.

U.S. Pat. No. 3,590,238 to Arens, which discloses a luminaire having a socket positioner for horizontally and vertically positioning the socket within the luminaire.

U.S. Pat. No. 4,300,187 to Fletcher, which discloses a reflector mounted for selective adjustment to different positions relative to a light source.

U.S. Pat. No. 4,675,794 to Fink, which discloses an adjustable mount for a high intensity lamp.

U.S. Pat. No. 5,017,327 to Bamber, which discloses an adjusting mechanism for focusing a light beam utilizing a screw within a threaded piston.

U.S. Pat. No. 5,086,379 to Denison et al., which discloses a low voltage outdoor floodlight having adjustable beam pattern.

U.S. Pat. No. 5,523,932 to Bogdanovs, which discloses a lighting fixture with adjustable reflector.

U.S. Pat. No. 5,785,416 to Hansen, which discloses a lamp having internal and external concentric shades, which may be adjusted against each other utilizing a spring biased friction sliding block to set the position of the shades.

In many cases, the primary adjustment necessary to effect proper installation of a lighting fixture is a widening or narrowing of the beam of light emanating from the fixture. This is often the case where multiple fixtures are to be installed with simple reflectors in an attempt to cover a large or irregular area. In such cases, a common goal is to light an area uniformly, without leaving areas between fixtures unlighted or other gaps in lighting.

However, a variety of light-directing effects may be achieved where a globe, refractor, or lens is utilized in the installation, as movement of a transparent or translucent refracting piece may direct and focus light into areas which would not be otherwise lighted. Whether the user is simply adjusting the width of the light beam from the fixture, or endeavoring to direct light by refractive means, much can be accomplished by movement of the shade, lens, reflector, or refractor, as the case may be, along a line parallel with the major axis of the fixture. The present invention is directed to just such movement, and a means for securing and adjusting the reflector or refractor used, with minimum of effort, time, tools, and materials.

While the devices disclosed in prior patents fulfill their respective objectives, prior patents and inventions do not describe or suggest the attachment of a spring-loaded, finger operable, engagement pin to a sliding mechanism having discrete holes, the sliding mechanism being attached on a first side to a reflector, and on a second side to a housing, the holes and pin of the sliding mechanism being oriented to allow the pin to engage the holes at a number of points as the parts of the sliding mechanism coact upon their assembly.

DISCLOSURE OF INVENTION

SUMMARY OF THE INVENTION

The lighting fixture in a lighting installation consists in its simplest form of a lighting base, housing, or socket, to which is attached a shade, lens, reflector, or refractor, as lighting needs dictate. The housing is typically fastened to a beam, joist, or other support member in the building to be lighted, on a pole in the lot to be lighted, or on another appropriate support in any area to be lighted. In its mounted position, the housing is supplied with electrical current. The shade, lens, reflector, or refractor, utilized to direct light as desired, is secured to the housing, and a lamp screwed into the socket of the fixture. The present invention provides a new apparatus for mounting the shade, lens, reflector, or refractor to the housing of the fixture, and thereafter conveniently adjusting the shade, lens, reflector, or refractor, as the case may be, to optimize the lighting effect.

In one preferred embodiment of the present invention, the shade adjusting apparatus comprises a sliding mechanism having two members which move in relation to each other. One member of the sliding mechanism may be attached to the fixture housing, or to some part of the housing. This member is thereby rendered immobile if the housing is attached to a beam or other supporting member. The other member of the sliding mechanism is attached to the shade, or other selected light-directing component. Upon engagement, the shade may therefore be easily moved in relation to the housing as one member of the sliding mechanism moves in relation to the other member of the mechanism. In the alternative, the members of the sliding mechanism may be formed as integral parts of the housing and shade, rather than constituting separate, attachable pieces.

The member of the sliding mechanism which is attached to the housing consists, in one preferred embodiment, of two flat prongs, which may be conveniently formed by bending a single flat metal strip into a generally "U-shaped" form. The metal strip may, upon attaining such form, be attached to the housing, or to some component of the fixture which is attached to the housing, at its base at the bottom of the U-shape. Fastening holes may be drilled into the metal strip prior to its formation so that the base of the strip may be easily attached to the housing, and other components of the fixture may be attached at the base.

Adjusting holes, corresponding to various positions of the shade once the second sliding member is fitted to the first sliding member, are formed in the metal strip, in a series, along the prongs of the U-shaped first member. The adjusting holes are sized to receive a matching pin. The pin may be supplied separately, but in the preferred embodiment of the present invention the pin resides on the second member of the sliding assembly. The adjusting holes are spaced to provide any convenient or desirable adjustment of the sliding members. While the placement of the holes may be even or uneven, such placement must be consistent with that degree of structural rigidity necessary to retain each component of the sliding assembly in place and free from bending or warping.

The second member of the sliding mechanism, which may be attached to the reflector or other light-directing component of the fixture, consists, in one preferred embodiment, of a flat metal ring having means for attachment to the reflectors and two additional flat prongs. Other means for attaching the second member of the sliding mechanism to the reflector may be utilized, such as simple flanges, however for most purposes a metal ring, whether flat or otherwise, will provide better support for the reflector. The metal ring may be angled at its outer edge to fit a conical shaped reflector, or otherwise manufactured to receive reflectors of other shapes.

A pin of appropriate size may be inserted into holes formed in one of the prongs or the second member of the sliding assembly or, in one preferred embodiment, into each of the prongs of the second member, so that the pins may freely moved through such holes. The pins are long enough, and appropriately sized, so that they may then extended through the holes in the second member and travel into the holes drilled in the first member of the sliding mechanism if the prongs of the first member are placed against the prongs of the second member.

In one preferred embodiment the pins are held "captive" on the prong of the second member of the sliding mechanism, so that the pins remain positioned for easy insertion through the prongs of the second member and into the prongs of the first member. The pins and their attachments are arranged to provide sufficient movement of the pins such that they may travel from a withdrawn position, in which they cannot coact with the holes of the first member of the sliding mechanism, to an extended position, in which they can coact with such holes. In such extended position, the pins secure the position of the prongs of the first and second members against each other. The pins may also be biased by spring loading or other means so that they tend to move inwardly toward the prongs of the first member if not held back, and so into the adjustment holes of that member.

In one preferred embodiment, the biased captive pins are retained in place, ready for actuation, but held back from movement toward the prongs of the first member by mechanical means until the user determines that such movement will be helpful in installation or adjustment of the shade. The retainer for holding the pins in proper position until they are needed may consist of a number of arrangements, however one convenient and easily manufactured means consists of providing generally cylindrical sections of tubing, attached to one member of the sliding mechanism of the present invention, through which the captive pins may travel, and other components which allow a user to actuate the pins at the appropriate time. The pins in such arrangement are sized and designed to travel through the tubing sections, and along their axis, but may move only little, if at all, in any other direction. The pins in such arrangement are also fitted with a larger head which may be manually operated to release the pins from their held back positions with one hand, thereby leaving a spare hand for other tasks.

The components which allow a user to actuate the pins at the appropriate time may consist, in one preferred embodiment, of a hold back mechanism, or "stop," seated under each manually operable captive pin head. The captive pin heads may be formed on the ends of the pins, the heads themselves being cylindrical and designed to fit over the cylindrical tubing sections of the retainer. The stop, which may be attached so as to turn if the pin head is turned, is formed with prongs which may bear against a step or ledge formed on the top of the retainers at their edge. The retainers may be formed with flat faces on their sides.

Since a flat face cut or formed on the side of a cylindrical shape reduces the radius of the cylinder, the step or ledge formed on the top of the retainers at their edge will be reduced in size or absent altogether at the point where the flat face is formed. As a result, if a user turns the captive pin head, thereby turning the mechanical stop, the prongs of the stop may no longer be restrained against movement, and may move down the flat face toward the base of the retainer. Such movement thereby allows movement of the pin head, and the captive pin to which the head is attached.

The captive pins may therefore coact with the pin retainers as prongs of the mechanical stop either do, or do not, match, the flat faces of the retainers, Upon matching, the pins may extend inwardly toward and through the prongs of the second member of the sliding assembly in one position, while preventing such movement in other positions.

In operation, the prongs of the mechanical stop rest atop the steps of the cylindrical sections of the retainers until the user wishes to secure a shade to a lighting housing; the interior wall of the pin head is too close to the diameter of the pin retainer to allow the prongs of the mechanical stop fit between the head and the retainer unless a flat portion of the retainer is encountered. However, during installation or adjustment of a lighting fixture, the user may turn the pin heads to orient the prongs of the stop into alignment with the flat portions of the retainers, at which points the mechanical stop and pin heads may move. The attached captive pins may then travel through the retainer, and toward or through the prongs of the two members of the sliding assembly, consistent with the bias applied to the pins by the biasing springs or other biasing means.

In a preferred embodiment of the present invention a clasp is also attached to each of the prongs of the second member in such fashion that the ends of the clasps form channels, having walls, into which the prongs of the first member may be inserted, and through which they may pass. When the prongs of the first member are then inserted into the channels of the clasps, the prongs of the first member may slide linearly through the channels, and against the walls of the channels and the prongs of the second member. However, the prongs of the first member are guided by the walls of the channels and the prongs of the second member to only move parallel with the prongs of the first member; the prongs of each member are constrained against movement other than parallel with one another.

When installing a reflector to a lighting housing, the user, through use of the present invention, after attaching the housing to a beam or other appropriate support and supplying electrical connections, is presented with a housing upon which are mounted the prongs of the first member of the sliding assembly. In the alternative, the user may fasten the first member of the sliding assembly to the housing if a sliding assembly is not already supplied. Having completed installation of the housing, the user may raise a shade into position by slipping the prongs of the first member of the sliding assembly into the channels formed by the prongs of the second member of the sliding assembly and the sidewalls of the clasps on each such prong.

Prior to raising the shade into position, the user will have set the captive pins at the end of their travel, against the bias of their springs. However, when the clasps and prongs of the second member of the sliding mechanism engage the prongs of the first member, the user may turn the heads of the captive pins to orient the pin heads to the flat faces of the retainers as explained above, thereby allowing the biasing means to act on the pins so that they bear inwardly toward the prongs of the second member of the sliding assembly. In this position, the user may simply slide the shade into resting position by sliding the second member of the sliding assembly along the first member of the sliding assembly until at least one pin on the second member of the sliding assembly aligns with at least one adjustment hole in the first member of the sliding assembly, at which point the pin so aligned is pushed into the hole and retained there by the pin biasing means. The user may then let go of the shade without fear of its falling. Since the user also employed the prongs of the sliding mechanism to position the shade during assembly, and the captive pins to "automatically" secure one member of the assembly to the other, the installation is accomplished with minimum time and effort in positioning and securing the shade. Upon securing the shade, the user may then install an appropriate lamp.

In the event the user determines that the shade may be further adjusted to better utilize the light emanating from the lamp, adjustment may be easily accomplished as the user may simply withdraw the pins of the second member of the sliding assembly, and maintain them in the withdrawn position by turning the pin heads so they no longer fit over the flat faces of the retainers, but again bear against the steps or ledges at the end of the retainers. In such position, the pins no long coact with the prongs of the first member of the sliding assembly, but allow movement of the second member along the first member. By moving the second member, and therefore the shade, to a new position considered optimal by the user, the light from the fixture is adjusted as desired. Once the shade is in a desired position, the user may then turn the captive screws again to allow them to coact with the adjustment holes of the first member of the sliding assembly. If the pins do not immediately coact with the holes of the first member, a small movement of the shade either toward or away from the housing secures the shade into place as the biasing means of the captive pins sets the pins into the next available holes on the prongs of the first member.

Since the captive pins are easily located and grasped, the user may accomplish any adjustment without tools, and without looking directly at the pins or the sliding assembly. The user's attention may therefore be directed to the areas into which light is to be cast as the adjustment takes place, thereby allowing the user to position the shade in precisely the correct orientation for optimal placement of light.

It may be appreciated that the channels of the second member of the sliding assembly may be formed directly from the prongs of that assembly, without resort to a separate clasp. In such case, the edges of the flat prongs of the second member may be bent back to form the channels into which the prongs of the first member may slip. Further, the captive pin need not extend through the clasp, as explained above, but may be set above or below the clasp. Further still, the pins need not be of a captive type, but may be supplied separately from the other components of the fixture. Each of these variations have their disadvantage, however, and the main description set forth above, along with the specific embodiment set forth below, are considered the best mode for practicing the present invention.

The more important features of the invention have thus been outlined, rather broadly, so that the detailed description thereof that follows may be better understood, and in order that the present contribution to the art may be better appreciated. Additional features of specific embodiments of the invention will be described below.

However, before explaining preferred embodiments of the invention in detail, it may be noted briefly that the adjustable lighting reflector bracket of the present invention substantially departs from pre-existing designs of the prior art, and in so doing provides the user with the highly desirable ability to mount a lighting shade, lens, reflector, or refractor, as the case may be, to a housing, which may already be fixed in place, and thereafter focus or direct light emanating from the lamp of the fixture to optimize light dispersal.

The bracket of the present invention also provides the user with the ability to mount such a shade lens, reflector, or refractor, and optimize light dispersal from the lighting fixture single-handedly, as the reflector may be lifted, positioned, and held in place with one hand, while the spring-loaded fastening pin on one part of the sliding mechanism may be actuated with one hand to engage the discrete holes of the other part of the sliding mechanism. Upon such engagement the reflector is installed, or adjusted to optimal position, without further need for screws, bolts, or other fastening means. As a result a user may easily install and adjust the reflector as against the housing, and position the reflector to an optimum position, directing light as the user desires, while leaving one hand free for the user to hold the reflector in the proper position during assembly.

In the present invention, a shade, lens, reflector, or refractor, as the case may be, may be installed a to a housing by simply sliding one member of a sliding mechanism on to another member of the sliding mechanism, and thereafter engaging a spring-loaded, finger-operable pin positioned on the first member of the sliding mechanism with a pre-drilled hole on the second member of the sliding mechanism. As the "captive" pin and pre-drilled hole are pre-positioned to be easily engaged, installation is quickly accomplished. Adjustment of a reflector or other light directing component is also easily accomplished, either during or after installation, as a plurality of pre-drilled holes are positioned along the second member of the sliding mechanism. The user is thereby offered a variety of engagements between the captive pin and the plurality of holes, and so a variety of positions in which to place the reflector upon final engagement between pin and hole. The arrangement of pin and holes on a sliding mechanism allows the user to adjust the reflector in relation to a housing, which may already be fastened to a beam, joist, or other mounting place, to thereby optimize light dispersion from the lighting fixture by adjusting the reflector after installation.

The simple pin-to-hole fastening of one part of the sliding mechanism to the other part of the sliding mechanism also provides the user freedom to view the area to be lighted during adjustment, as such a simple securing means may be actuated even while looking away from the fixture, while the bias of the spring-loaded pin automatically urges the pin into the next available hole encountered along one member of the sliding mechanism, and secures the reflector in place upon engagement with that hole. Accordingly, the reflector of a lighting installation may, by use of the present invention, be secured to a fixture housing, and adjusted to optimal position, quickly, without additional tools, and often without requiring an assistant to hold the reflector while the user actuates the securing means.

These consequences arising by use of the present invention result in substantial savings in user time, and allows even a single installer to examine the area to be lighted during adjustment, and adjust accordingly. It may be appreciated a need exists for a new adjustable lighting reflector bracket which allows just such capabilities.

OBJECTS OF THE INVENTION

The principal object of the present invention is to provide a new mounting assembly for use with lighting and lighting fixtures which provides the user with a means to quickly and easily mount a reflector to a lighting housing, which may already be fixed in place, and thereafter adjust the reflector to focus or direct light emanating from the lamp of the fixture to optimize light dispersal.

A further object of the present invention is to provide a mounting assembly of a design which allows a user to install a reflector, and adjust the reflector in relation to the housing to an optimum position, directing light as the user desires, while leaving one hand free for the user to hold the reflector in the proper position during assembly.

A further object of the present invention is to provide a mounting assembly which offers a variety of engagements in the adjusting mechanism, and so a variety of positions in which to place the reflector upon final engagement, to optimize light dispersion from the lighting fixture.

A further object of the present invention is to provide a mounting assembly which allows a user to secure a reflector to a fixture housing, and adjust it to optimal position, without additional tools, and often without assistance.

A further object of the present invention is to provide a mounting assembly which allows the user to install and adjusted a reflector to optimal position without screws, bolts, or other fastening means.

A further object of the present invention is to provide a mounting assembly which allows the user to adjusted a reflector to optimal position while viewing the area to be lighted during adjustment, as the user can locate the captive pin fastening means quickly by touch, and easily manipulate the captive pin with the fingers of one hand while looking away from the fixture.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF A FIRST PREFERRED EMBODIMENT

Figure 1:
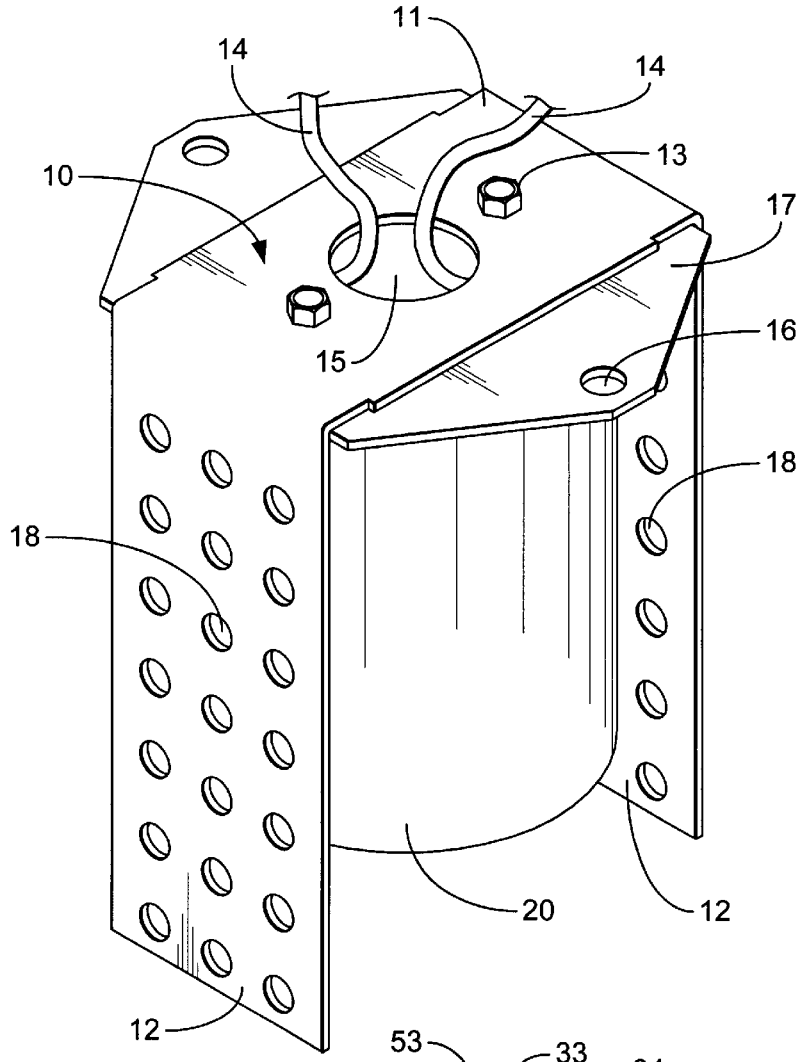
FIG. 1 is a top-side perspective view of a first preferred embodiment of the first "U-shaped" member of the mounting and adjusting assembly constructed in accordance with the principles of the present invention, into which is affixed a ceramic socket of standard design.

Referring initially to FIG. 1, the first "U-shaped" member 10 of the mounting and adjusting assembly constructed in accordance with the principles of the present invention is shown. To the base 11 of the first member 10, and between the prongs 12 of the member, is affixed a light socket 20 of standard design. The socket 20 is affixed to the base 11 by screws 13, while electrical wire connectors 14 may be extended through a hole 15 formed in the base 11 to connect the socket 20 with a source of electricity in a lighting fixture housing (not shown). The entire first member 10 and socket 20 may be attached to the lighting fixture housing by screws (not shown) placed through mounting holes formed in the base, or by screws placed through mounting holes 16 formed in a separate mounting plate 17 inserted between the base 11 and the socket 20. The base 10 may be attached to the fixture housing at the time of installation or, more appropriately, at the time of assembly of the housing at the factory before shipping.

A plurality of adjusting holes 18 are drilled or otherwise formed in a line, in a series, along the prongs 12 of the U-shaped first member 10. The adjusting holes 18 are sized to receive a matching "captive pin" (shown in FIG. 2) residing on the second, matching, member (shown in FIG. 2) of the sliding assembly of the present invention.

Figure 2:
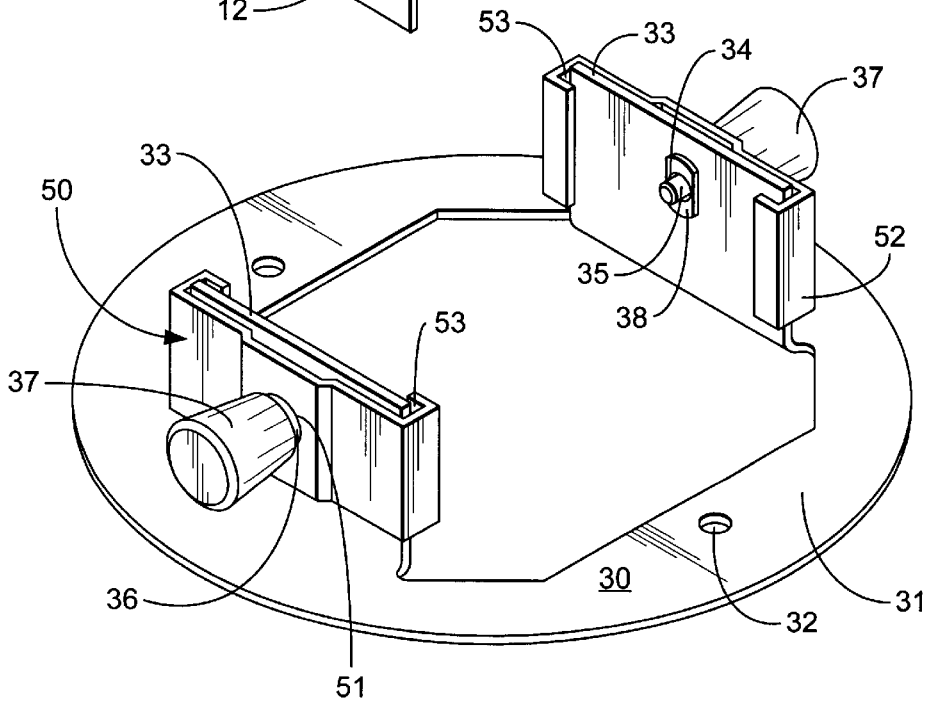
FIG. 2 Is a top-side perspective view of the matching second part of the same embodiment of the mounting and adjusting assembly of the present invention found in FIG. 1.

In FIG. 2, the second member 30 of the mounting and adjusting sliding assembly constructed in accordance with the principles of the present invention is shown. The second member may be attached to a reflector (not shown) or other light-directing component of the lighting fixture at base 31, which in FIG. 2 comprises a flat metal ring having attachment holes 32 formed at appropriate locations for fastening the second member 30 to the reflector. Two additional flat prongs 33 are shown in FIG. 2, which prongs are formed by bending portions from the center of the base 31 upon its cutting to form the ring of the base. Holes 34 are formed in the second member 30 for insertion of a captive pin 35 into and through each of the prongs 33 of the second member. The captive pins 35 on the prongs 33 of the second member 30 are held in place on the second member by pin retainers 36, and actuated by a user utilizing finger-operable heads 37.

Clasps 50, having holes 51 near their centers, are shaped to fit around the prongs 33 of the second member 30 in a generally "C-shaped" form. The pin retainers 36 are secured to the second member by use of pin retainer nuts 38, which screw into the pin retainers after passing through the prongs 33 of the second member. Pin retainer nuts 38 also pass through the clasp holes 51 prior to engagement with the pin retainers 36, thereby also securing the clasps 50 to the prongs 33 of the second member. The curved ends 52 of clasps 50 are also formed to just fit around the prongs 12 of the first member 10 if the prongs 12 of the first member 10 are positioned against the prongs 33 of the second member 30. The curved ends 52 of clasps 50 therefore create channels 53 through which the prongs 12 of the first member 10 may travel as the ends of the prongs 12 are placed in position against the prongs 33 of the second member 30, and the prongs 12 of the first member 10 are then slid along the prongs 33 of the second member 30 toward the base ring 31 of the second member 30.

Figure 3:
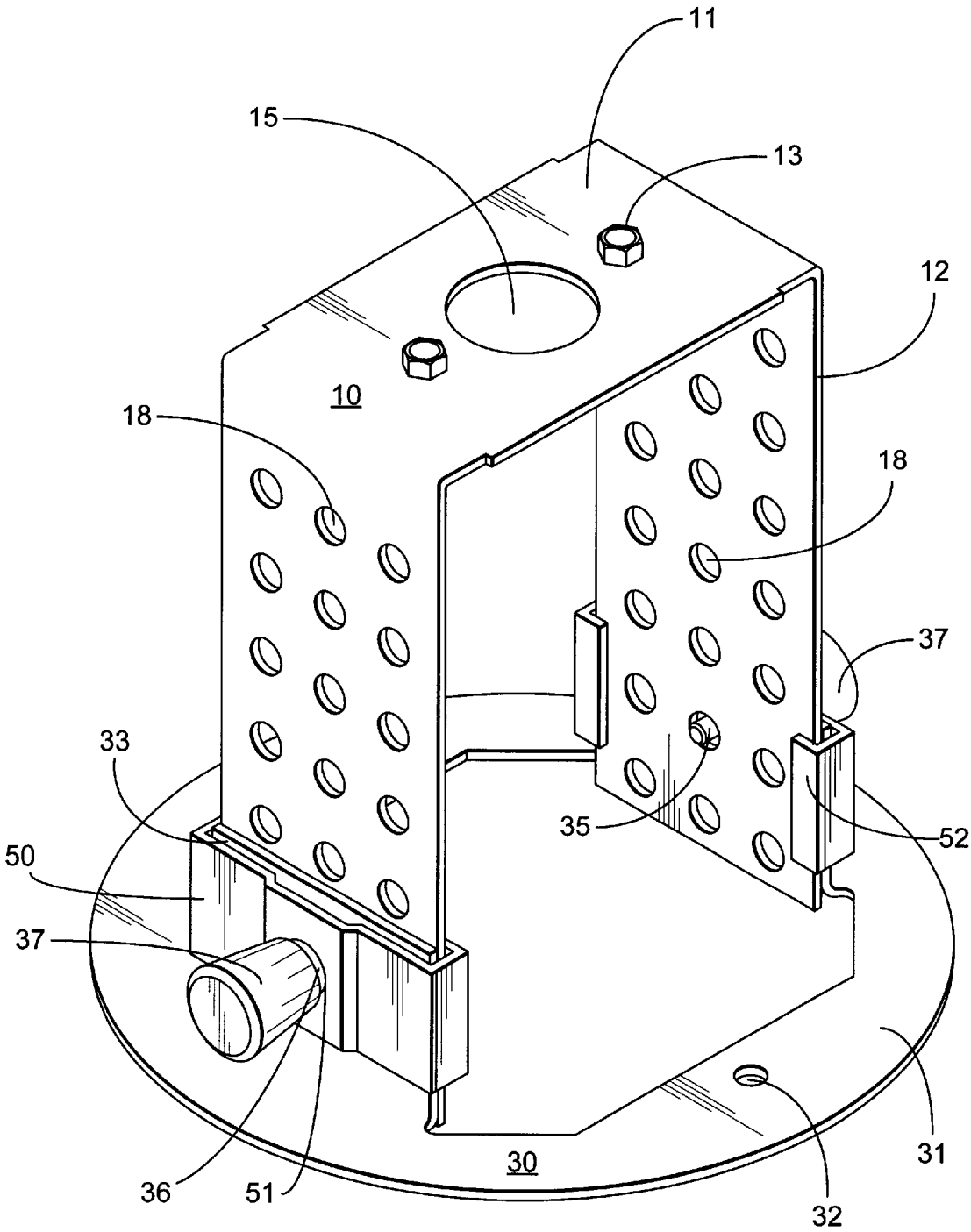
FIG. 3 is a top-side perspective view of the first and second members of the embodiment of FIGS. 1 and 2, in which the matching members are assembled by sliding engagement between the first and second members.

FIG. 3 shows the first member 10 and the second member 30 upon their assembly. In use, the first member 10 of the mounting and adjusting assembly is generally affixed to a lighting fixture housing (not shown) at the time of assembly of the housing, and the housing affixed to a beam or ceiling joist. The first member is thereby rendered stationary. The second member 30 is affixed to end of the reflector, shade, or refractor (not shown) selected for directing light in the lighting application at hand. Upon affixation of the housing, and connection of its wiring to the socket 20, the user positions the selected shade near the housing, and the ends of the prongs 33 of the second member 30 near the ends of the prongs 12 of the first member 10. The user then guides prongs 12 into channels 53 formed by the ends 52 of clasps 50, and slides prongs 33 against prongs 12, the sides of prongs 12 sliding within channels 53, until the reflector is in the desired position in relation to the housing, socket 20, and the bulb screwed therein, whereupon the user may actuate the captive pins 35 by manipulation of their finger-operable heads 37.

Figure 4:
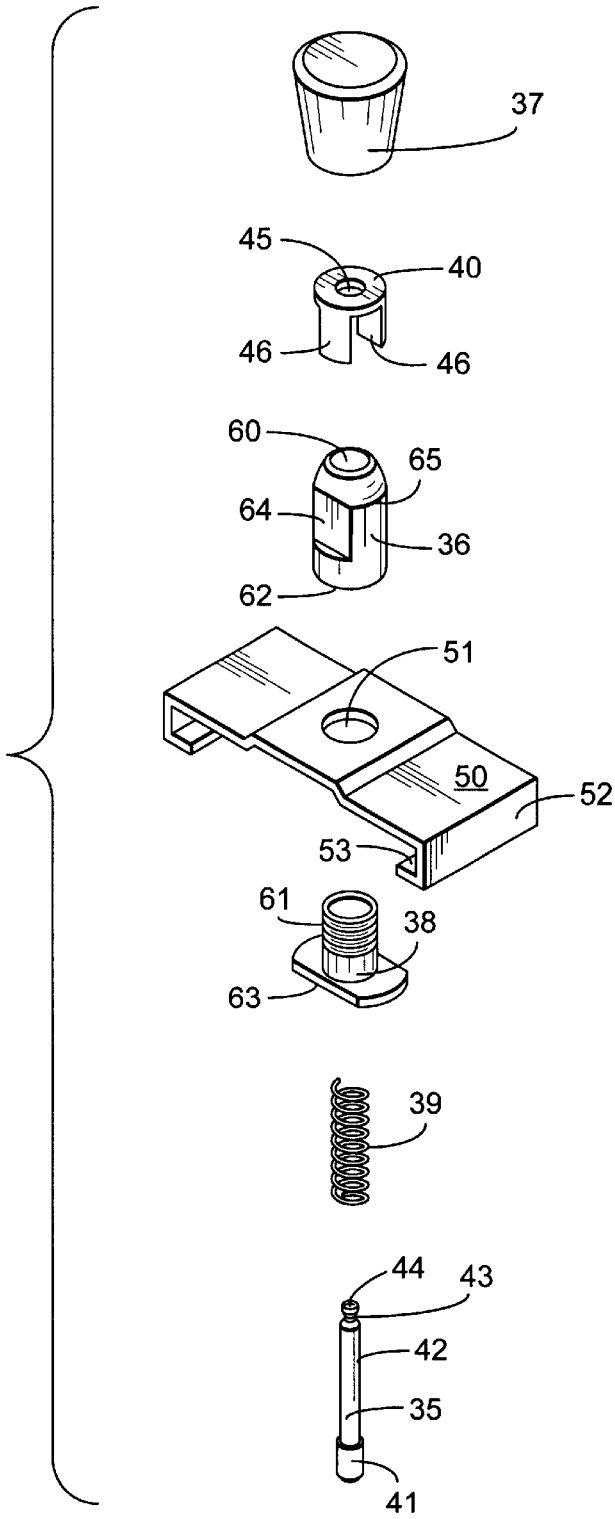
FIG. 4 is an exploded perspective view of the captive pin assembly shown in FIGS. 1 through 2, with clasp.

FIG. 4 shows an exploded view of the captive pin assembly, including a pin 35, a pin spring 39 biasing means, a pin retainer nut 38, a pin retainer 36, a pin finger-operable head 37, a pin stop 40, and a clasp 50. The captive pin 35 has a wide portion 41 which, when actuated, moves through the retainer nut 38 with minimal clearance. The wide portion 41 also extends through a prong 33 of the second member 30, and may, when actuated, extend through a prong 12 of the first member 10. The narrow section 42 of the captive pin 35 extends through the biasing spring 39, through pin retainer 36, through pin stop 40, and into the finger-operable head 37, where the narrow end 44 of the pin 35 is secured to the head. Upon assembly, the biasing spring 39 resides around the narrow section 44 of the pin, and is trapped between the wide portion 41 of the pin and the interior of the pin retainer 36 at its top. Pin stop 40 is formed with pin stop hole 45, through which pin 35 extends, and stop 40 is tightly fitted to pin 35 at pin stop hole 45. Pin stop 40 is also formed with pin stop prongs 46.

Upon assembly, retainer nut 38 is inserted through a prong 33 of second member 30 and through clasp hole 51 of clasp 50. The captive pin 35, with biasing spring 39 in place around narrow section 42, is then inserted into the bottom aperture of pin retainer nut 38. Pin retainer 36 is then joined with retainer nut 38 as it extends through prong 33 and clasp 50, and pin retainer 36 is then screwed onto retainer nut 38 by engaging retainer nut threads 61 with corresponding threads on the interior of the pin retainer. Utilizing the exterior edges 63 of retainer nut 38 and the two flat faces 64 formed on the exterior of pin retainer 36, the user may screw the pin retainer 36 and the pin retainer nut 38 together until they bear, respectively, against the clasp 50 and the prong 33 of the second member 30. As the prong 33 of the second member is recessed to receive the retainer nut 38, the nut does not protrude from the face of the prong 33, but presents virtually a flat surface for smooth interaction with the corresponding prong 12 of the first member 10.

Continuing with assembly, the pin stop 40 is fitted over the narrow section 42 of the captive pin 35; the captive pin hole 45 fitting tightly around the narrow section 44 of the pin 35 near its narrow end 44. Continuing, the finger-operable head 37 is then fitted over the narrow section 42 of the captive pin 35, and the finger-operable head fastened securely to the captive pin at its narrow end 44. The narrow end 44 of the captive pin 35 is, after such fastening, positioned within the finger-operable head 37 as shown in FIG. 5.

Figure 5:
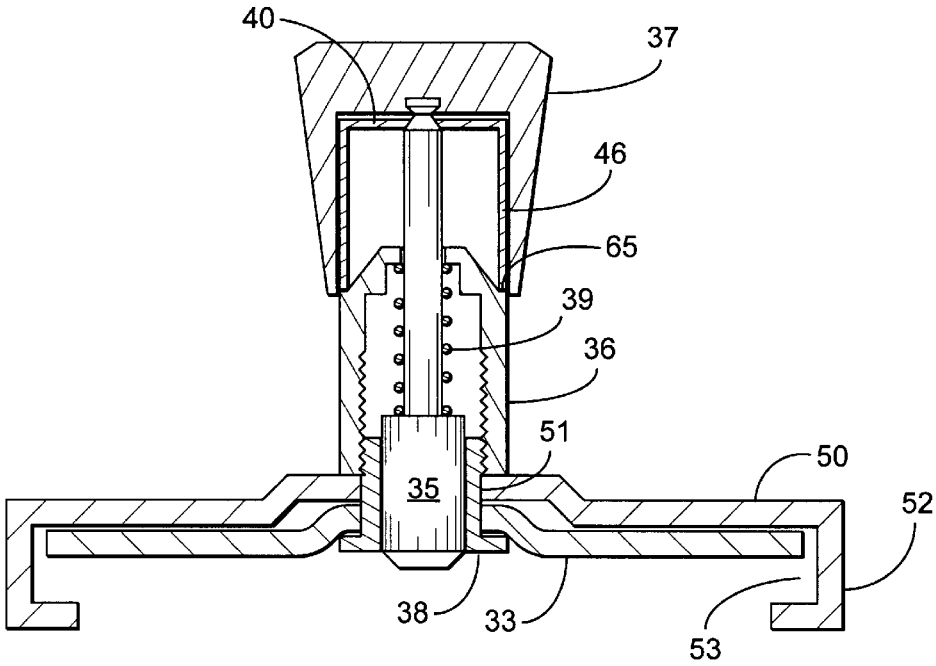
FIG. 5 is a cross sectional view of the captive pin assembly, with clasp, affixed to a prong of the second member of the assembly shown in FIGS. 1 through 3, and resting in its withdrawn position.
Figure 6:
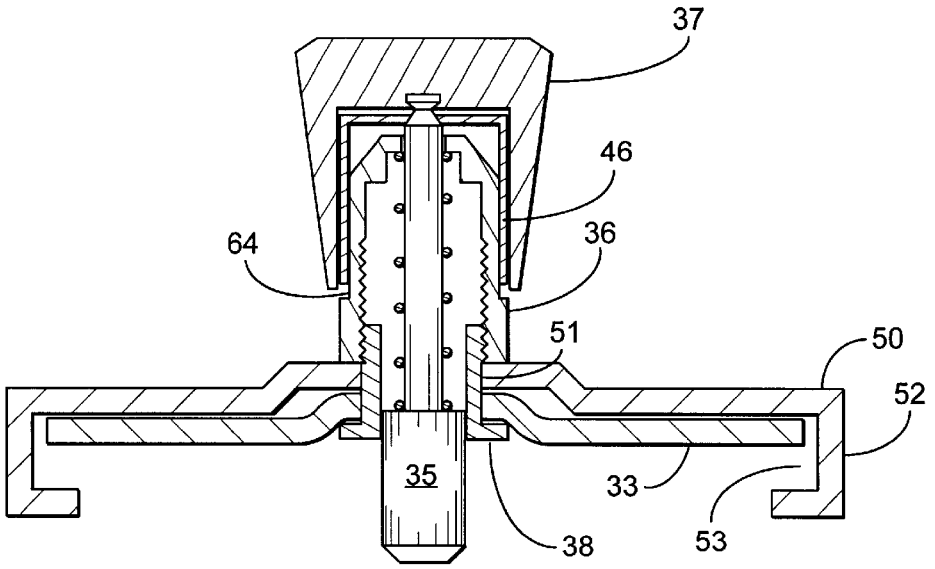
FIG. 6 is a cross sectional view of the captive pin assembly of FIG. 5 in its extended position.

FIGS. 5 and 6 show, in cross section, one captive pin assembly, with clasp 50, after assembly to a prong 33 of the second member 30, and the action of the captive pin 35 as it is activated. In FIG. 5, the ends of pin stop prongs 46 are being urged by biasing spring 39 to bear against pin retainer ledges 65, which run around the top of pin retainer 36. In such withdrawn position, captive pin 35 cannot move through retainer nut 38, or into a prong 12 of first member 10. However, as shown in FIG. 6, when the user grasps pin head 37, and turns it approximately a quarter turn in either direction, pin stop prongs 46, as they are positioned over the flat faces 64 of the pin retainer 36, find no pin retainer ledge 65. Pin stop prongs 46 may therefore move toward clasp 50, thereby allowing the pin stop 40, the pin head 37, and the captive pin 35 all to move to an extended position as shown in FIG. 6. In such extended position, the biasing spring 39 urges the captive pin 35 through prong 33 of second member 30, and either against prong 12 of the first member 10, or into one of the adjusting holes 18 formed in prong 12. Once inserted into an adjusting hole 18, the captive pin 35 thereafter stops any further movement between the prongs 12 of the first member and the prongs 33 of the second member, thereby securing the reflector (attached to the second member) to the housing (to which the first member is attached) at the position desired by the user.

What is claimed is:

1. An adjustable bracket for mounting a lighting reflector to a lighting housing comprising:

a first sliding member having a plurality of first flat prongs, the first prongs having edges, the first prongs having a plurality of adjustment holes, the first adjustment holes being formed parallel with the major axis of the lighting housing and lighting reflector, a second sliding member having a plurality of second prongs, the second prongs having edges, the second prongs each having a stationary second adjustment hole for insertion of a plurality of pins, means for holding the first prongs in sliding engagement with the second prongs, comprising a plurality of clasps, the plurality of clasps affixed to the plurality of second prongs, the plurality of clasps having ends shaped to form channels through which the edges of the first prongs and the edges of the second prongs may pass, the plurality of clasps each having clasp holes near the center thereof, the clasp hole of each clasp is positioned approximately in alignment with the corresponding stationary adjustment holes of the second prongs of the second sliding member, and a plurality of captive pins situated near the plurality of clasp holes, the plurality of captive pins each having first ends and second ends, the captive pins positioned so that their first ends reside adjacent to the plurality of clasp holes.

2. The mounting bracket of claim 1, further comprising biasing means for urging the first ends of the captive pins through the clasp holes and the second adjustment holes of the second prongs of the second sliding member.

3. The mounting bracket of claim 2, wherein the plurality of captive pins are held from moving through the second adjustment holes of the second prongs of the second sliding member, against the urging of the biasing means, by hold back means.

4. The mounting bracket of claim 3 wherein the hold back means comprises a plurality of stops, attached to the captive pin second ends, and rotatable thereon, whereby the hold back means is actuated by rotating the stops on the heads of the captive pins.

5. The mounting bracket of claim 4, further comprising a plurality of finger-operable heads, bearing against the stops, by which the stops may be rotated.

6. The mounting bracket of claim 2, wherein the biasing means comprises a spring.

7. The mounting bracket of claim 6, wherein the plurality of captive pins are held from moving through the second adjustment holes of the second prongs of the second sliding member, against the urging of the biasing means, by hold back means.

8. The mounting bracket of claim 7, wherein the hold back means comprises a plurality of stops, attached to the captive pin second ends, and rotatable thereon, whereby the hold back means is actuated by rotating the stops on the heads of the captive pins.

9. The mounting bracket of claim 8, further comprising a plurality of finger-operable heads, bearing against the stops, by which the stops may be rotated.

10. A captive pin assembly for fixing the position of a first sliding member against a second sliding member comprising:

a generally cylindrical retainer having a first end, a second end, an interior, an exterior, a generally circular first opening at the retainer first end, and a generally circular second opening at the second end, the retainer having a region of larger exterior diameter near the retainer first end and a region of smaller exterior diameter near the retainer second end, the retainer having a pin retainer ledge formed circumferentially on the retainer exterior at the intersection of the region of larger exterior diameter and the region of smaller exterior diameter, the pin retainer ledge having a generally flat surface oriented generally perpendicularly to the axis of the retainer and facing toward the retainer second end, the retainer having at least one flat face formed along the retainer exterior, the at least one flat face extending along the retainer length from a point near the retainer first end to the region of smaller exterior diameter, a pin residing within the retainer, the pin having a first end and a second end, the pin having a sufficiently small diameter at its first end to fit through the generally circular first opening at the retainer first end, the pin having a sufficiently small diameter at its second end to fit through the generally circular second opening at the retainer second end, the pin being longer than the retainer, a biasing means, for urging the pin to move toward the retainer first end, so that the pin first end may extend from the first end of the retainer, a stop, attached to the pin second end, for holding the pin against the urging of the biasing means, the stop having a plurality of prongs, the prongs formed to bear against the generally flat surface of the pin retainer ledge upon the urging of the biasing means, the prongs formed to slip past the pin retainer ledge and along the retainer at least one flat face when the prongs are oriented toward the retainer at least one flat face, a clasp having a first end and a second end, and a hole near its center through which the first end of the pin may pass when the generally circular first opening of the retainer is situated near the clasp hole, and means for securing the retainer at its first end to the clasp.

11. The captive pin assembly of claim 10, further comprising a head, situated at the second end of the pin, and cooperating therewith, for easy hand operating of the pin.

* * * * *